United States Patent [19]

Haque

[11] Patent Number: 5,042,728

[45] Date of Patent: Aug. 27, 1991

[54] CEREAL MILL SYSTEM

[75] Inventor: Ekramul Haque, Manhattan, Kans.

[73] Assignee: Kansas State University Research Foundation, Manhattan, Kans.

[21] Appl. No.: 457,378

[22] Filed: Dec. 27, 1989

[51] Int. Cl.[5] ..... B02C 9/04

[52] U.S. Cl. ..... 241/159; 241/235

[58] Field of Search ..... 241/117, 235, 159, 13; 426/518

[56] References Cited

U.S. PATENT DOCUMENTS

| | | | |
|---|---|---|---|
| 11,401 | 7/1854 | Ziegler | 249/159 |
| 136,321 | 2/1873 | Harvey | 241/235 X |
| 847,371 | 3/1907 | Robinson . | |
| 1,781,186 | 11/1930 | Maxwell . | |
| 2,468,279 | 4/1949 | Von Liedtke . | |
| 2,925,226 | 2/1960 | Pratique . | |
| 3,167,261 | 1/1965 | Wonneberger | 241/159 |
| 3,491,952 | 1/1970 | Krolopp | 241/13 |
| 3,910,506 | 10/1975 | Pecci | 241/159 X |
| 4,465,239 | 8/1984 | Woten | 241/159 X |
| 4,613,087 | 9/1986 | Snyder . | |
| 4,752,038 | 6/1988 | Takahashi et al. . | |

FOREIGN PATENT DOCUMENTS

| | | | |
|---|---|---|---|
| 84602 | 7/1921 | Austria | 241/159 |
| 529980 | 7/1954 | Belgium | 241/159 |
| 529980 | 7/1954 | Belgium | 241/159 |
| 115440 | 8/1984 | European Pat. Off. | 241/159 |
| 247656 | 6/1912 | Fed. Rep. of Germany | 241/159 |
| 3823929 | 2/1989 | Fed. Rep: of Germany | 241/159 |
| 484925 | 8/1914 | France | 241/159 |
| 8652 | of 1887 | United Kingdom | 241/235 |
| 11562 | of 1907 | United Kingdom | 241/235 |
| 2172 | of 1910 | United Kingdom | 241/235 |
| 198120 | 5/1923 | United Kingdom | 241/159 |

*Primary Examiner*—Mark Rosenbaum
*Assistant Examiner*—Frances Chin
*Attorney, Agent, or Firm*—Hovey, Williams, Timmons & Collins

[57] ABSTRACT

A roller mill system (10) for grains such as wheat provides a frame structure (12), power apparatus (14), and first, second and third roller structures (16,18,20) collectively presenting an inverted pyramidal configuration. In this fashion three rollers (76,90,102) provide two nips or passages (122,124), thus eliminating the need for a fourth roller as in conventional two-passsage mills. Grain or the like is fed from grain hopper (38) into passage (122) where it undergoes processing action such as mashing or crimping. The grain is then transported to passage (124) for a second processing action. The processed grain, which is now reduced in particle size, is conveyed to a collection site (146) for further processing or packaging. Due to the relative angular velocities of rollers (76,90,102), all grain is transported to second passage (124) and virtually none escapes through passage (126). This is true despite the lack of any feeding mechanism to introduce the processed grain from (122) to passage (124). In the preferred embodiment the respective relative angular velocities for the first roller (76), second roller (90) and third roller (102) are 198 rpm counterclockwise, 135 rpm clockwise and 230 rpm counterclockwise.

8 Claims, 4 Drawing Sheets

CEREAL MILL SYSTEM

BACKGROUND OF THE INVENTION

1. Field of the Invention

This invention relates to a cereal mill for processing grain and the like. More particularly it is concerned with a mill having three corrugated, non-intercalating rollers disposed in an inverted pyramidal configuration and rotated at different speeds so as to advantageously provide a pair of processing passages or nips without the conventional need for a fourth roller.

2. Description of the Prior Art

Roller mills are widely used in the grain industry for size reduction processes such as cracking, flaking and grinding. Such mills have been used for hundreds of years and have traditionally provided pairs of rollers, each pair being closely configured to define a passageway so that the grain travels through one or more passages between respective pairs of rollers in the course of a processing regimen.

In order to reduce the number of components, and thus the attendant construction costs, various schemes have been proposed for utilizing one roller in conjunction two other rollers so that two passages are formed between the three rollers. These configurations have been substantially vertical in nature and thus have required additional equipment to ensure that grain being processed from the first passage is fed into the next passage rather than being discharged randomly.

What is needed is a three roller mill which needs no feeding mechanism for introducing the grain to the second passage point. Such a device would channel substantially all grain from the first passage to the second without requiring any additional guiding structure to accomplish this purpose.

SUMMARY OF THE INVENTION

The problems outlined above are in large measure solved by the improved cereal mill system in accordance with the present invention. That is to say, the mill hereof is an efficient design which reduces construction costs by eliminating the requirement of a fourth roller as well as eliminating the necessity of a feeding mechanism for the second passage.

The milling system in accordance with the present invention broadly includes a frame, a power plant and three rollers suitably mounted on the frame and connected with the power plant for rotational movement. The power plant advantageously rotates the first, second and third rollers at respective angular velocities so that when the grain travels through the passage defined by the nip of the first and second rollers, it is conveyed adjacent to and then through the second passage defined by the nip of the second and third rollers.

In preferred forms, the rollers present an inverted pyramidal configuration, are cylindrical in shape and each has a corrugated work periphery to enhance the conveying and processing of grain. In particularly preferred forms, the respective amounts of corrugation and angular velocities of the first, second and third rollers are predetermined so that all of the grain transmitted through the first passage travels to the second passage while virtually none of the grain is conveyed through the nip defined by the first and third rollers.

DESCRIPTION OF THE PREFERRED EMBODIMENT

Figure 1:
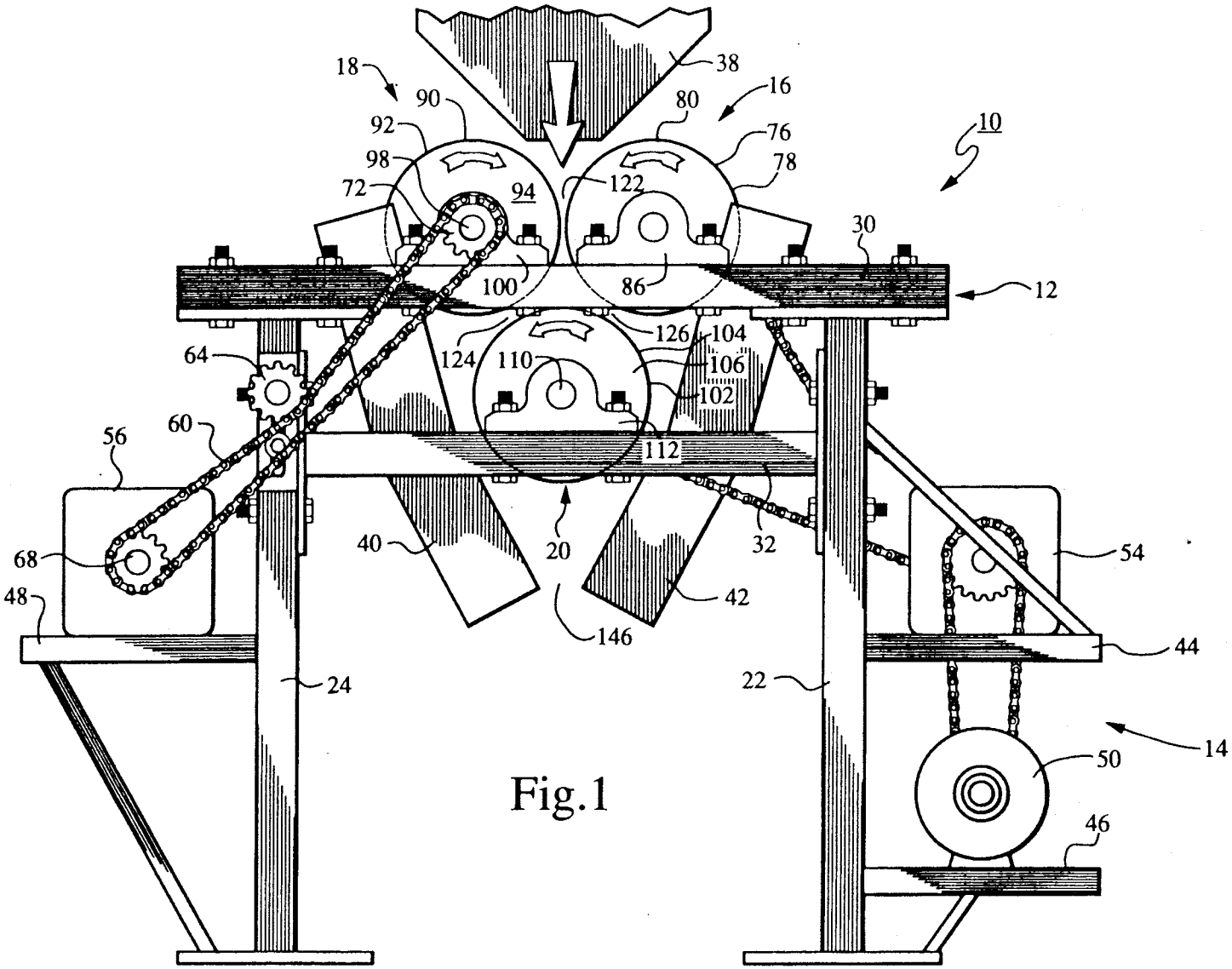
FIG. 1 is a front elevational view of the preferred cereal mill system in accordance with the present invention.

Referring now to the drawings in general and FIG. 1 in particular, an improved cereal mill system 10 in accordance with the invention broadly includes frame structure 12, power apparatus 14, first roller structure 16, second roller structure 18, and third roller structure 20. Grain or the like is introduced above the configuration of roller structures 16, 18 and 20, is suitably processed, and is then delivered in a processed condition below.

In more detail, frame structure 12 includes legs 22–28 (see also FIG. 2), integral crosspieces 30–36 (see also FIG. 2) respectively affixed thereto, grain hopper 38, front and back safety guards (not shown), processing guides 40,42, and platforms 44–48. Grain hopper 38 is affixed to the rest of frame structure 12 by connective structure (not shown). Likewise, the front and back safety guards are mounted on frame 12, by means not shown for ease of illustration.

Figure 2:
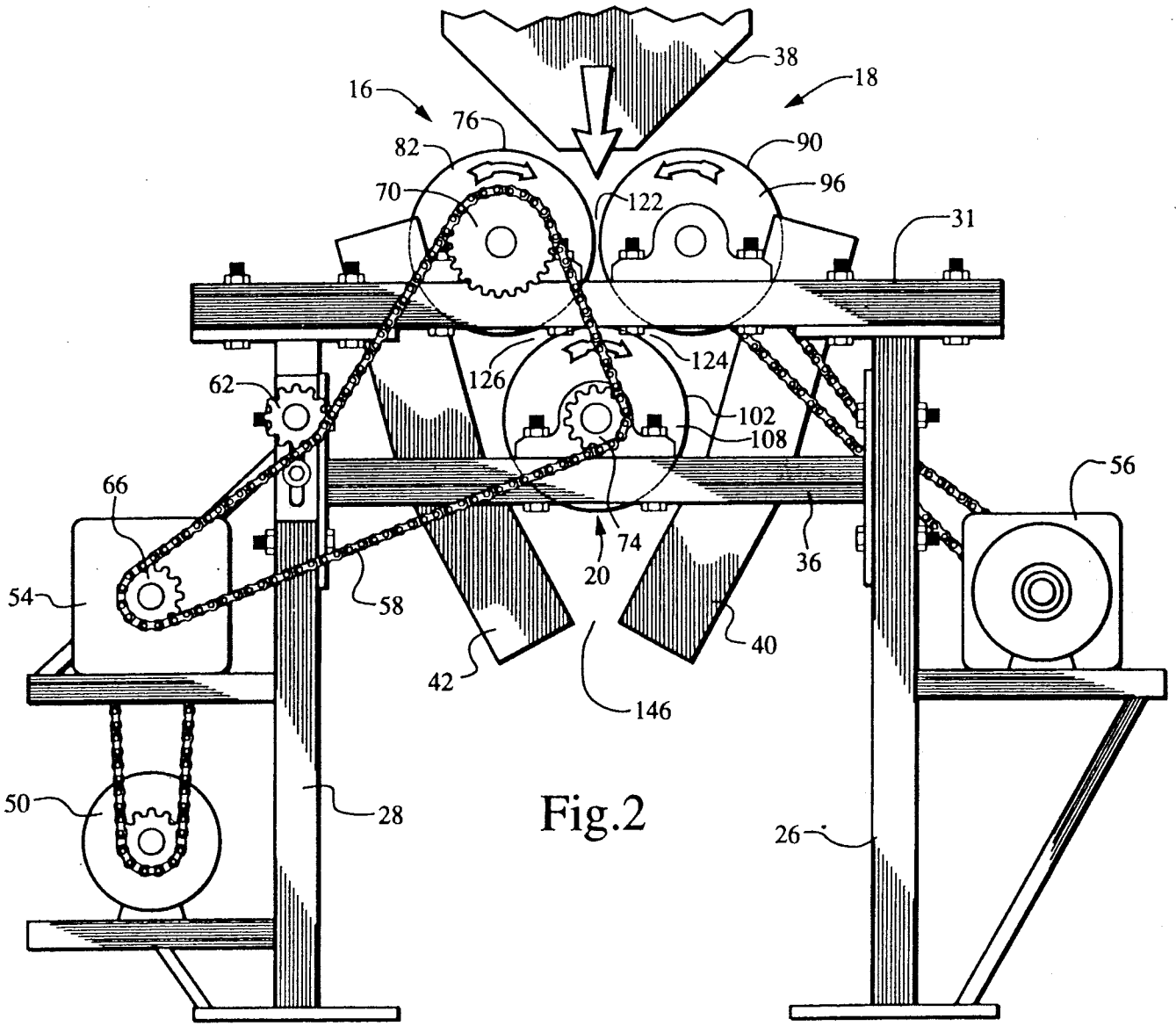
FIG. 2 is a rear elevational view of the system.
Figure 3:
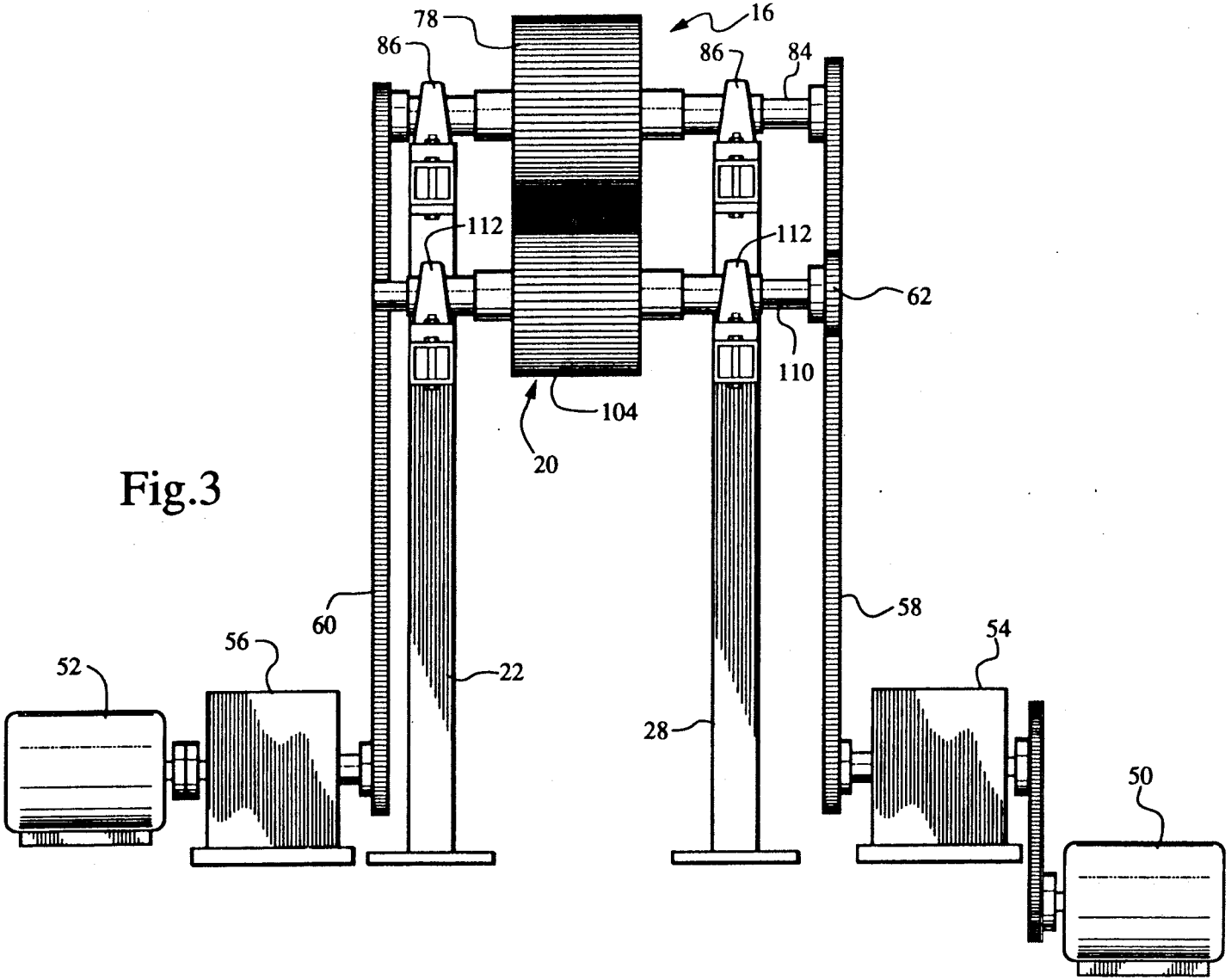
FIG. 3 is a side elevational view of the system as viewed from the right in FIG. 1.

Referring now generally to FIGS. 1–3, power apparatus 14 includes motors 50,52, gear reducers 54,56, chains 58,60, idler sprockets 62,64, gear reducer sprockets 66,68, first roller sprocket 70, second roller sprocket 72, third roller sprocket 74 and appropriate connections between the respective motors and gear reducers. It will be noted that the FIG. 3 view of the motors 50,52 and gear reducers 54,56 does not conform to the spacial arrangement as shown in FIGS. 1 and 2. This is simply for ease of illustration in FIG. 3, as is the elimination of grain guide 42 which facilitates better viewing of the roller configuration. Both frame structure 12 and power apparatus 14 are conventional in design and well known in the art and thus will not be described in greater detail.

Still referring generally to FIGS. 1–3, first roller structure 16 includes roller 76 having a work periphery 78 and two end peripheries 80,82. First roller structure 16 further includes axle 84 which is rotatably mounted on frame 12 by means of housing 86 and bearings (not shown).

Second roller structure 18 includes second roller 90 having a work periphery 92 and end peripheries 94,96. Second roller structure 18 further includes axle 98 which is rotatably mounted on frame 12 by means of housing 100 and bearings (not shown).

Third roller structure 20 includes third or lower roller 102 having a work periphery 104 and end peripheries 106,108. Roller structure 20 further includes axle 110 which is rotatably mounted on frame 12 by means of housing 112 and bearings (not shown).

Figure 4:
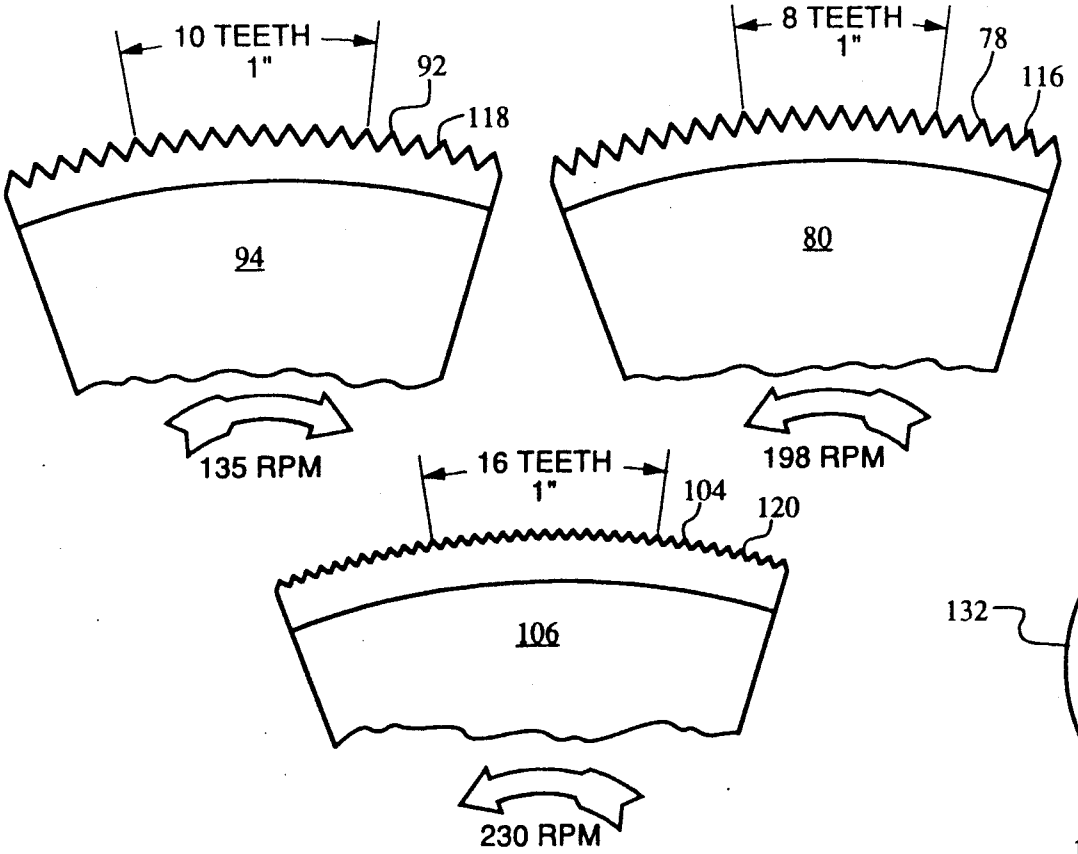
FIG. 4 is a detailed view of certain portions of the first, second and third rollers.

Referring to FIG. 4, respective end portions 80, 94 and 106 of first, second and third roller structures 16, 18 and 20 are depicted in a partial view to reveal respective teeth or corrugations 116, 118 and 120 of work peripheries 78, 92, and 104.

Referring to FIG. 1, first roller structure 16 and second roller structure 18 cooperatively form a pair of rollers 76,90 having a first nip or passage 122 while second roller structure 18 and third roller structure 20 are configured to form second nip or passage 124. First roller structure 16 and third roller structure 20 are configured to form another nip or passage 126. The actual size of the passages as drawn is not to scale but is made larger in the views of FIG. 1 and 2 for ease of illustration. The nips are set so that corrugations from the respective rollers do not intermesh or intercalate.

Figure 5:
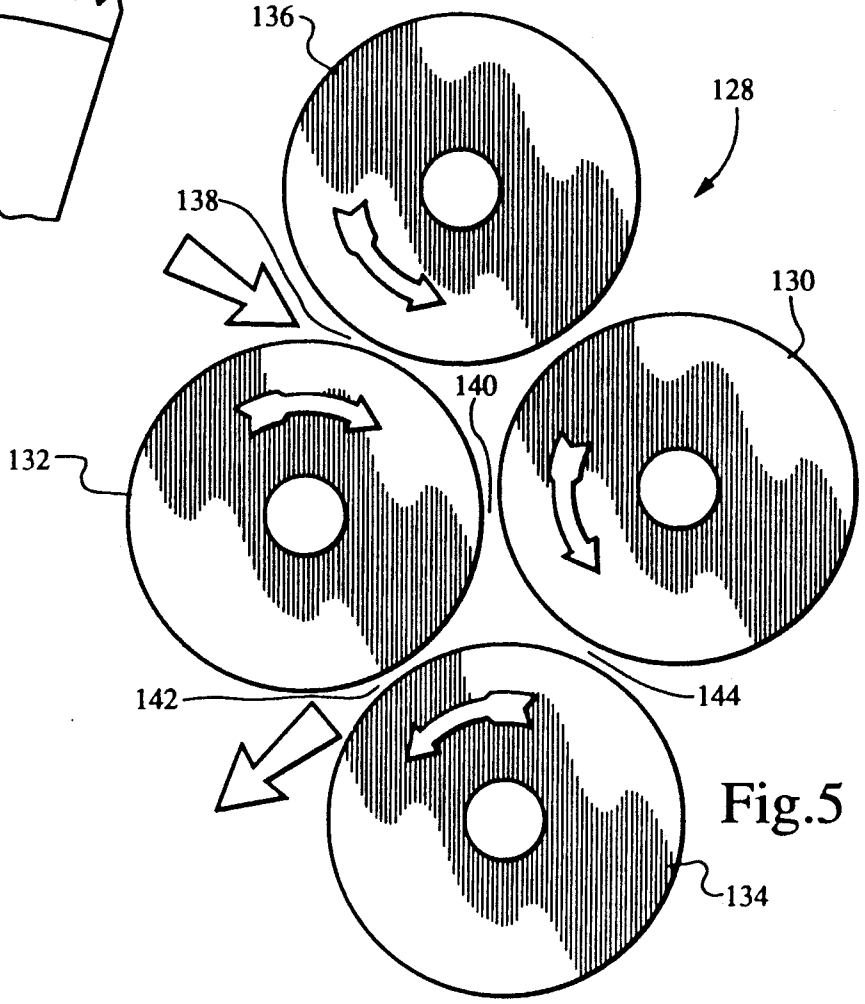
FIG. 5 is a partial, schematic view of another embodiment of the present invention.

Referring to FIG. 5, another roller mill system 128 is shown wherein four roller mills 130–136 are depicted. In this embodiment, the pyramidal configuration of first, second and third rollers 130–134 is slightly geometrically different from that of system 10 in order to accommodate a fourth roller 136 so that passages 138–144 are formed.

In operation, and referring to FIG. 1, grain (or any other material to be processed) is introduced into hopper 38 which has appropriate structure for controlling the flow to a predetermined rate. The grain or other material is then introduced into passage 122 as indicated by the direction of the large arrow. Housings 86,100 are suitably adjusted prior to operation, in a manner well known in the art, to size the passage 122 to an appropriate gap dimension for the desired process, whether it be crimping, flaking, cracking, etc. The grain is then processed through passage 122 and conveyed by the rotating action of cylinders 76, 90 and 102 to second passage 124 where it undergoes a second processing step. For example, grain might be cracked at 122 and then further reduced in size to a flour-like consistency at passage 124.

In any event, the grain is then conveyed through passage 124 and drops down guide 40 to a point 146 where it can be collected for further processing or packaging as appropriate. It will readily be appreciated that the rollers 76, 90 and 102 are generally rotated at unequal angular velocities by advantageous selection of sprockets 70–74 and idler sprockets 62,64 in conjunction with the appropriate settings of motors 50,52, gear reducers 54,56, chains 58,60, and idler sprockets 62,64. As viewed in FIG. 1, first and third rollers 76, 102 rotate in a counterclockwise fashion while second roller 90 rotates in a clockwise fashion. Thus, by the appropriate gap dimension of passage 126 in conjunction with the relative rotational velocities of the three rollers, it is assured that virtually all the grain is conveyed towards passage 124 and virtually none escapes through passage 126. The relative amount of corrugation for the lower roller 102 is greater than that of the pair of rollers 76,90 in the preferred embodiment to enhance this effect. Thus, no feeding mechanism is required to ensure that all of the grain travels from passage 122 to 124, as was required in the prior art.

In the preferred embodiment, the optimum parameters for the above-described process are as follows: 1) each of the rollers has a diameter of nine inches and an axial length of 6 inches; 2) the corrugations per inch of roll, as indicated in FIG. 4, are 8 corrugations per inch, 10 corrugations per inch and 16 corrugations per inch respectively for the first roller 76, second roller 90 and third roller 102; and 3) the respective angular speeds are 198 rpm, 135 rpm and 230 rpm. The gap dimensions will vary with the size of grain and type of process but the gap of passage 126 should be small enough so that processed material cannot easily pass therethrough.

Although rollers 76, 90 and 120 will be under greater stress than would four rollers in a conventional two passage design, this no longer poses a significant problem. Those skilled in the art will appreciate that as long as the rollers are constructed of a sufficiently hard, durable material, system 10 will maintain its structural integrity for a period of time comparable with older four roller systems.

FIG. 5 schematically shows the operation of system 128 wherein a fourth roller 136 is added to create an additional passage 138. The geometric configuration of roller 130 relative to rollers 134 and 136 is slightly adjusted so that roller 130 is slightly elevated with respect to roller 132. Therefore no grain or other processed material coming from passage 138 can pass between rollers 130 and 136. Thus, no passage is indicated thereat. All of the material is processed from passage 138 to passage 140 and the relative velocities of rollers 130 and 134 will again be designed so that there is virtually no grain lost at passage 144. In other words, the magnitude of the angular velocity of roller 134 will be greater than that of roller 130 so that grain is conveyed in a counterclockwise direction as it strikes roller 134 and thus is pulled away from passage 144. The grain is then conveyed out through passage 140 to passage 142 as indicated by the arrow. Once again, the dimensions of the passages are not exact but rather are exaggerated for ease of illustration.

Thus, it will be readily appreciated that any number of rollers may be accommodated within the scope of the invention. For example, instead of a four roller, three passage configuration, a five roller, four passage configuration could be utilized. Hence it will be seen that the possibilities for reducing the total number of rollers for a given number of passages is practically unlimited within the scope of this invention.

I claim:

1. A system for milling of grain products, comprising:

a pair of adjacent, juxtaposed grinding rollers each presenting a surrounding periphery defining an upper nip grain processing region therebetween;

a lower roller presenting a periphery thereon and positioned beneath and substantially centrally between said pair of roller to define therewith a spaced pair of lower nip regions;

structure defining a plurality of substantially identical, axially extending and continuous, uniformly dimensioned corrugations on the periphery of each of said rollers respectively, with the number of corrugations per circumferential inch on said lower roller being greater than the number of corrugations per circumferential inch on either of said pair of rollers;

frame means mounting said rollers in said positions with the corrugations of each roller being slightly spaced from the corrugations of the adjacent rollers whereby none of the corrugations of the rollers intercalate with the corrugations of the other rollers;

power means for axially rotation said rollers at respective speeds and directions for receipt and processing of grain products first into and through said upper nip and then into and through only one of said lower nip regions, said one of said lower nip regions being sized to define a second grain processing region, with no significant amounts of said grain products passing through the other of said nip regions.

2. The system of claim 1, each of said rollers having a substantially cylindrical shape.

3. The system of claim 2, the radial dimension of each of said rollers being substantially equal.

4. The system of claim 1, wherein said pair of rollers presents 8 and 10 corrugations per inch of periphery respectively, and said lower roller presents 16 corrugations per inch of periphery.

5. The system of claim 1, the direction of rotation of said pair of rolls being counterclockwise and clockwise respectively, and counterclockwise for said lower roll.

6. The system of claim 1, said power means including structure for rotating said pair of rollers at about 198 and 135 rpm respectively, and said lower roller at about 230 rpm.

7. The system of claim 1, further including at least a fourth roller disposed above said pair of rollers so as to define a fourth nip with one roller of said pair of rollers so that grain is received into and passed through said fourth nip before being received at said upper nip.

8. The system of claim 1, the axis of rotation of each of said pair of rollers together defining a substantially horizontal plane.

* * * * *